US009757796B2

(12) United States Patent
Sherman et al.

(10) Patent No.: US 9,757,796 B2
(45) Date of Patent: Sep. 12, 2017

(54) MANUFACTURE OF CONTROLLED RATE DISSOLVING MATERIALS

(71) Applicant: Terves, Inc., Euclid, OH (US)

(72) Inventors: Andrew Sherman, Mentor, OH (US); Brian Doud, Cleveland Heights, OH (US); Nicholas Farkas, Euclid, OH (US)

(73) Assignee: Terves, Inc., Euclid, OH (US)

( * ) Notice: Subject to any disclaimer, the term of this patent is extended or adjusted under 35 U.S.C. 154(b) by 47 days.

(21) Appl. No.: 14/627,236

(22) Filed: Feb. 20, 2015

(65) Prior Publication Data

US 2015/0240337 A1 Aug. 27, 2015

Related U.S. Application Data

(60) Provisional application No. 61/942,879, filed on Feb. 21, 2014.

(51) Int. Cl.
*B22D 23/06* (2006.01)
*B22D 19/14* (2006.01)
(Continued)

(52) U.S. Cl.
CPC ..... *B22D 23/06* (2013.01); *B22D 19/14* (2013.01); *B22D 21/007* (2013.01); *B22D 21/04* (2013.01);
(Continued)

(58) Field of Classification Search
CPC ..... C22C 23/00; C22C 23/02; E21B 7/061
See application file for complete search history.

(56) References Cited

U.S. PATENT DOCUMENTS 3,180,728 A 4/1965 Pryor et al.
3,445,731 A 5/1969 Saeki et al.
(Continued)

FOREIGN PATENT DOCUMENTS

WO 9200961 8/1992
WO 2013019410 2/2013
(Continued)

OTHER PUBLICATIONS

National Physical Laboratory. "Bimetallic Corrosion." 2000. Crown (C). p. 1-14.*
(Continued)

*Primary Examiner* — Colleen Dunn
*Assistant Examiner* — Nicholas Wang
(74) *Attorney, Agent, or Firm* — Fay Sharpe LLP

(57) ABSTRACT

A castable, moldable, or extrudable structure using a metallic base metal or base metal alloy. One or more insoluble additives are added to the metallic base metal or base metal alloy so that the grain boundaries of the castable, moldable, or extrudable structure includes a composition and morphology to achieve a specific galvanic corrosion rates partially or throughout the structure or along the grain boundaries of the structure. The insoluble additives can be used to enhance the mechanical properties of the structure, such as ductility and/or tensile strength. The insoluble particles generally have a submicron particle size. The final structure can be enhanced by heat treatment, as well as deformation processing such as extrusion, forging, or rolling, to further improve the strength of the final structure as compared to the non-enhanced structure.

41 Claims, 3 Drawing Sheets

(51) Int. Cl.

| | |
|---|---|
| ***B22D 21/00*** | (2006.01) |
| ***B22D 21/04*** | (2006.01) |
| ***B22D 25/06*** | (2006.01) |
| ***B22D 27/00*** | (2006.01) |
| ***B22D 27/08*** | (2006.01) |
| ***C22C 23/00*** | (2006.01) |
| ***C22C 23/02*** | (2006.01) |
| ***C22C 47/08*** | (2006.01) |
| ***C22C 49/04*** | (2006.01) |
| ***C22C 49/14*** | (2006.01) |
| ***B22D 27/02*** | (2006.01) |
| ***B22D 27/11*** | (2006.01) |
| ***B22F 1/00*** | (2006.01) |
| ***C22C 1/03*** | (2006.01) |
| *C22C 49/02* | (2006.01) |

(52) U.S. Cl.

CPC ..... *B22D 25/06* (2013.01); *B22D 27/00* (2013.01); *B22D 27/02* (2013.01); *B22D 27/08* (2013.01); *B22D 27/11* (2013.01); *B22F 1/004* (2013.01); *C22C 1/03* (2013.01); *C22C 23/00* (2013.01); *C22C 23/02* (2013.01); *C22C 47/08* (2013.01); *C22C 49/04* (2013.01); *C22C 49/14* (2013.01); *B22F 2301/35* (2013.01); *B22F 2304/05* (2013.01); *B22F 2999/00* (2013.01); *C22C 49/02* (2013.01)

(56) References Cited

U.S. PATENT DOCUMENTS

| | | | | |
|---|---|---|---|---|
| 4,264,362 | A | 4/1981 | Sergev et al. | |
| 5,106,702 | A | 4/1992 | Walker et al. | |
| 5,980,602 | A * | 11/1999 | Carden | A61L 27/04 257/E23.112 |
| 6,422,314 | B1 | 7/2002 | Todd et al. | |
| 6,444,316 | B1 | 9/2002 | Reddy et al. | |
| 6,527,051 | B1 | 3/2003 | Reddy et al. | |
| 6,554,071 | B1 | 4/2003 | Reddy et al. | |
| 6,737,385 | B2 | 5/2004 | Todd et al. | |
| 7,647,964 | B2 | 1/2010 | Akbar et al. | |
| 8,211,247 | B2 | 7/2012 | Marya et al. | |
| 8,211,248 | B2 | 7/2012 | Marya | |
| 8,211,331 | B2 | 7/2012 | Jorgensen et al. | |
| 8,327,931 | B2 | 12/2012 | Agrawal et al. | |
| 8,403,037 | B2 | 3/2013 | Agrawal et al. | |
| 8,413,727 | B2 | 4/2013 | Holmes | |
| 8,425,651 | B2 | 4/2013 | Xu et al. | |
| 8,485,265 | B2 | 7/2013 | Marya et al. | |
| 8,528,633 | B2 | 9/2013 | Agrawal et al. | |
| 8,573,295 | B2 | 11/2013 | Johnson et al. | |
| 8,631,876 | B2 | 1/2014 | Xu et al. | |
| 8,663,401 | B2 | 3/2014 | Marya et al. | |
| 8,714,268 | B2 | 5/2014 | Agrawal et al. | |
| 8,905,147 | B2 | 12/2014 | Fripp et al. | |
| 2005/0194141 | A1 | 9/2005 | Sinclair et al. | |
| 2006/0175059 | A1 | 8/2006 | Sinclair et al. | |
| 2006/0207387 | A1 | 9/2006 | Soran et al. | |
| 2007/0181224 | A1 | 8/2007 | Marya et al. | |
| 2008/0105438 | A1 * | 5/2008 | Jordan | C22C 1/0408 166/376 |
| 2009/0226340 | A1 | 9/2009 | Marya | |
| 2011/0135530 | A1 | 6/2011 | Xu et al. | |
| 2011/0221137 | A1 | 9/2011 | Obi et al. | |
| 2012/0080189 | A1 | 4/2012 | Marya et al. | |
| 2012/0177905 | A1 | 7/2012 | Seals et al. | |
| 2012/0318513 | A1 | 12/2012 | Mazyar et al. | |
| 2013/0029886 | A1 | 1/2013 | Mazyar et al. | |
| 2013/0032357 | A1 | 2/2013 | Mazyar et al. | |
| 2013/0056215 | A1 | 3/2013 | Crews | |
| 2013/0068411 | A1 | 3/2013 | Forde et al. | |
| 2013/0160992 | A1 | 6/2013 | Agrawal et al. | |
| 2013/0168257 | A1 | 7/2013 | Mazyar et al. | |
| 2013/0199800 | A1 | 8/2013 | Kellner et al. | |

FOREIGN PATENT DOCUMENTS

| | | |
|---|---|---|
| WO | 2013019421 | 2/2013 |
| WO | 2013122712 | 8/2013 |
| WO | 2013154634 | 10/2013 |

OTHER PUBLICATIONS

U.S. Search Authority, International Search Report and Written Opinion for related application No. PCT/US2015/016776 (dated May 27, 2015).

Sigworth et al., "Grain Refinement of Aluminum Castings Alloys" American Foundry Society; Paper 07-067; pp. 5, 7 (2007).

Momentive, "Titanium Diborid Powder" condensed product brochure; retrieved from https://www.momentive.com/WorkArea/DownloadAsset.aspx?id+27498>; p. 1 (2012).

Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf>(2005).

Peguet et al., "Influence of cold working on the pitting corrosion resistance of stainless steel" Corrosion Science, vol. 49, pp. 1933-1948 (2007).

* cited by examiner

MANUFACTURE OF CONTROLLED RATE DISSOLVING MATERIALS

The present invention claims priority on U.S. Provisional Application Ser. No. 61/942,879 filed Feb. 21, 2014, which is incorporated herein by reference.

FIELD OF THE INVENTION

The invention is directed to a novel material for use as a dissolvable structure in oil drilling. Specifically, the invention is directed to a ball or other structure in a well drilling or completion operation, such as a structure that is seated in a hydraulic operation, that can be dissolved away after use so that that no drilling or removal of the structure is necessary. Primarily, dissolution is measured as the time the ball removes itself from the seat or can become free floating in the system. Secondarily, dissolution is measured in the time the ball is fully dissolved into submicron particles. Furthermore, the novel material of the present invention can be used in other well structures that also desire the function of dissolving after a period of time. The material is machinable and can be used in place of existing metallic or plastic structures in oil and gas drilling rigs including, but not limited to, water injection and hydraulic fracturing.

BACKGROUND OF THE INVENTION

The ability to control the dissolution of a down hole well structure in a variety of solutions is very important to the utilization of non-drillable completion tools, such as sleeves frack balls, hydraulic actuating tooling and the like. Reactive materials for this application, which dissolve or corrode when exposed to acid, salt, and/or other wellbore conditions, have been proposed for some time. Generally, these consist of materials that are engineered to dissolve or corrode. Dissolving polymers and some powder metallurgy metals have been disclosed, and are also used extensively in the pharmaceutical industry, for controlled release of drugs.

While these systems have enjoyed modest success in reducing well completion costs, their consistency and ability to specifically control dissolution rates in specific solutions, as well as other drawbacks such as limited strength and poor reliability, have impacted their ubiquitous adoption. Ideally, these structures would be manufactured by a process that is low cost, scalable, and produces a controlled corrosion rate having similar or increased strength as compared to traditional engineering alloys such as aluminum, magnesium, and iron. Ideally, traditional heat treatments, deformation processing, and machining techniques would be used without impacting the dissolution rate and reliability of such structures.

SUMMARY OF THE INVENTION

The present invention is directed to a castable, moldable, or extrudable structure using a metal or metallic primary alloy. Non-limiting metals include aluminum, magnesium, aluminum and zinc. Non-limiting metal alloys include alloys of aluminum, magnesium, aluminum and zinc. One or more additives are added to the metallic primary metal or alloy to form a novel composite. The one or more additives are selected and used in quantities so that the grain boundaries of the novel composite contain a desired composition and morphology to achieve a specific galvanic corrosion rate in the entire composite or along the grain boundaries of the composite. The invention adopts a feature that is usually a negative in traditional casting practices wherein insoluble particles are pushed to the grain boundary during the solidification of the melt. This feature results in the ability to control where the particles are located in the final casting, as well as the surface area ratio which enables the use of lower cathode particle loadings compared to a powder metallurgical or alloyed composite to achieve the same dissolution rates. The addition of insoluble particles to the metal or metal alloy can be used to enhance mechanical properties of the composite, such as ductility and/or tensile strength, when added as submicron particles. The final casting can optionally be enhanced by heat treatment as well as deformation processing, such as extrusion, forging, or rolling, to further improve the strength of the final composite over the as-cast material. The deformation processing achieves strengthening by reducing the grain size of the metal alloy composite. Further enhancements, such as traditional alloy heat treatments such as solutionizing, aging and cold working, can optionally be used without dissolution impact if further improvements are desired. Because galvanic corrosion is driven by both the electro potential between the anode and cathode phase, as well as the exposed surface area of the two phases, the rate of corrosion can also be controlled through adjustment of cathode particle size, while not increasing or decreasing the volume or weight fraction of the addition, and/or by changing the volume/weight fraction without changing the particle size.

In one non-limiting aspect of the invention, a cast structure can be made into almost any shape. During solidification, the active reinforcement phases are pushed to the grain boundaries and the grain boundary composition is modified to achieve the desired dissolution rate. The galvanic corrosion can be engineered to only affect the grain boundaries and/or can also affect the grains based on composition. This feature can be used to enable fast dissolutions of high-strength lightweight alloy composites with significantly less active (cathode) reinforcement phases compared to other processes.

In another and/or alternative non-limiting aspect of the invention, ultrasonic dispersion and/or electro-wetting of nanoparticles (if nanoparticle cathode additions are desired) can be used for further enhancement of strength and/or ductility with minor nanoparticle additions.

In still another and/or alternative non-limiting aspect of the invention, a metal cast structure is produced by casting with at least one insoluble phase in discrete particle form in the metal or metal alloy. The discrete insoluble particles have a different galvanic potential from the base metal or metal alloy. The discrete insoluble particles are generally uniformly dispersed through the base metal or base metal alloy using techniques such as thixomolding, stir casting, mechanical agitation, electrowetting, ultrasonic dispersion and/or combinations of these methods; however, this is not required. Due to the insolubility and difference in atomic structure in the melt material and the insoluble particles, the insoluble particles will be pushed to the grain boundary during casting solidification. Because the insoluble particles will generally be pushed to the grain boundary, such feature makes engineering grain boundaries to control the dissolution rate of the casting possible. This feature also allows for further grain refinement of the final alloy through traditional deformation processing to increase tensile strength, elongation to failure, and other properties in the alloy system that are not achievable without the use of insoluble particle additions. Because the ratio of insoluble particles in the grain boundary is generally constant and the grain boundary to grain surface area is typically consistent even after deformation processing and heat treatment of the composite, the corrosion rate of such composites remain very similar or constant.

In yet another and/or alternative non-limiting aspect of the invention, the metal cast structure can be designed to corrode at the grains, the grain boundaries and/or the insoluble particle additions depending on selecting where the particle additions fall on the galvanic chart. For example, if it is desired to promote galvanic corrosion only along the grain boundaries, a base metal or base metal alloy can be selected that is at one galvanic potential in the operating solution of choice where its major grain boundary alloy composition will be more anodic as compared to the matrix grains (i.e., grains that form in the casted base metal or base metal alloy), and then an insoluble particle addition can be selected which is more cathodic as compared to the major grain boundary alloy composition. This combination will corrode the material along the grain boundaries, thereby removing the more anodic major grain boundary alloy composition at a rate proportional to the exposed surface area of the cathodic particle additions to the anodic major grain boundary alloy. The current flowing in the system can be calculated by testing zero resistance current of the cathode to the anode in the solution at a desired temperature and pressure. Corrosion of the composite will be generally proportional to current density current/unit area of the most anodic component in the system until that component is removed. If electrical conductivity remains between the remaining components in the system, the next most anodic component in the system will be removed next.

In still yet another and/or alternative non-limiting aspect of the invention, galvanic corrosion in the grains can be promoted by selecting a base metal or base metal alloy that sits at one galvanic potential in the operating solution of choice where its major grain boundary alloy composition will be more cathodic as compared to the matrix grains (i.e., grains that form in the casted base metal or base metal alloy), and an insoluble particle addition can be selected that is more cathodic compared to the major grain boundary alloy composition and the matrix grains (i.e., grains that form in the casted base metal or base metal alloy). This combination will result in the corrosion of the composite material through the grains by removing the more anodic grain composition at a rate proportional to the exposed surface area of the cathodic particle additions to the anodic major grain boundary alloy. The current flowing in the system can be calculated by testing zero resistance current of the cathode to the anode in the solution at a desired temperature and pressure. Corrosion of the composite is generally proportional to current density current/unit area of the most anodic component in the system until that component is removed. If electrical conductivity remains between the remaining components in the system, the next most anodic component in the system will be removed.

In another and/or alternative non-limiting aspect of the invention, when a slower corrosion rate is desired, two or more different insoluble particle compositions can be added to the base metal or base metal alloy to be deposited at the grain boundary. If the system is chosen so that the second insoluble particle composition is the most anodic in the entire system, it will be corroded, thereby generally protecting the remaining components based on the exposed surface area and galvanic potential difference between it and the surface area and galvanic potential of the most cathodic system component. When the exposed surface area of the second insoluble particle composition is removed from the system, the system reverts to the two previous embodiments described above until more particles of the second insoluble particle composition are exposed. This arrangement creates a mechanism to retard the corrosion rate with minor additions of the second insoluble particle composition.

In still another and/or alternative non-limiting aspect of the invention, the rate of corrosion in the entire casting system can be controlled by the surface area and, thus, the particle size and morphology of the insoluble particle additions.

In yet another and/or alternative non-limiting aspect of the invention, there is provided a metal cast structure wherein the grain boundary composition and the size and/or shape of the insoluble phase additions can be used to control the dissolution rate of such composite. The composition of the grain boundary layer can optionally include two added insoluble particles having a different composition with different galvanic potentials, either more anodic or more cathodic as compared to the base metal or base metal alloy. The base metal or base metal alloy can include magnesium, zinc, titanium, aluminum, iron, or any combination or alloys thereof. The added insoluble particles that have a more anodic potential than the base metal or base metal alloy can optionally include beryllium, magnesium, aluminum, zinc, cadmium, iron, tin, copper, and any combinations and/or alloys thereof. The insoluble particles that have a more cathodic potential than the base metal or base metal alloy can optionally include iron, copper, titanium, zinc, tin, cadmium lead, nickel, carbon, boron carbide, and any combinations and/or alloys thereof. The grain boundary layer can optionally include an added component that is more cathodic as compared to the base metal or base metal alloy. The composition of the grain boundary layer can optionally include an added component that is more cathodic as compared to the major component of the grain boundary composition. The grain boundary composition can be magnesium, zinc, titanium, aluminum, iron, or any combination of any alloys thereof. The composition of the grain boundary layer can optionally include an added component that is more cathodic as compared to the major component of the grain boundary composition and the major component of the grain boundary composition can be more anodic than the grain composition. The cathodic components or anodic components can be compatible with the base metal or base metal alloy in that the cathodic components or anodic components can have solubility limits and/or do not form compounds. The component (anodic component or cathodic component) can optionally have a solubility in the base metal or base metal alloy of less than about 5% (e.g., 0.01-4.99% and all values and ranges therebetween), typically less than about 1%, and more typically less than about 0.5%. The composition of the cathodic components or anodic components in the grain boundary can be compatible with the major grain boundary material in that the cathodic components or anodic components have solubility limits and/or do not form compounds. The strength of metal cast structure can optionally be increased using deformation processing and a change dissolution rate of less than about 20% (e.g., 0.01-19.99% and all values and ranges therebetween), typically less than about 10%, and more typically less than about 5%. The ductility of the metal cast structure can optionally be increased using nanoparticle cathode additions. In one non-limiting specific embodiment, the base metal or base metal alloy includes magnesium and/or magnesium alloy, and the more cathodic particles include carbon and/or iron. In another non-limiting specific embodiment, the base metal or base metal alloy includes aluminum and/or aluminum alloy, the more anodic galvanic potential particles or compounds include magnesium or magnesium alloy, and the high galvanic potential cathodic particles include carbon, iron and/or iron alloy. In still another non-limiting specific embodiment, the base metal or base metal alloy includes aluminum, aluminum alloy, magnesium and/or magnesium alloy, and the more anodic galvanic potential particles include magnesium and/or magnesium alloy and the more cathodic particles include titanium. In yet another non-limiting specific embodiment, the base metal or base metal alloy includes aluminum and/or aluminum alloy, and the more anodic galvanic potential particles include magnesium and/or magnesium alloy, and the high galvanic potential cathodic particles include iron and/or iron alloy. In still yet another non-limiting specific embodiment, the base metal or base metal alloy includes aluminum and/or aluminum alloy, and the more anodic galvanic potential particles include magnesium and/or magnesium alloy, and the high galvanic potential cathodic particles include titanium. In another non-limiting specific embodiment, the base metal or base metal alloy includes magnesium, aluminum, magnesium alloys and/or aluminum alloy and the high galvanic potential cathodic particle includes titanium. The metal cast structure can optionally include chopped fibers.

The additions to the metal cast structure can be used to improved toughness of the metal cast structure. The metal cast structure can have improved tensile strength and/or elongation due to heat treatment without significantly affecting the dissolution rate of the metal cast structure. The metal cast structure can have improved tensile strength and/or elongation by extrusion and/or another deformation process for grain refinement without significantly affecting the dissolution rate of the metal cast structure. In such a process, the dissolution rate change can be less than about 10% (e.g., 0-10% and all values and ranges therebetween), typically less than about 5%, and more typically less than about 1%. The metal cast structure can optionally have controlled or engineered morphology (being particle shape and size of the cathodic components) to control the dissolution rate of the metal cast structure. The insoluble particles in the metal cast structure can optionally have a surface area of 0.001 $m^2/g$-200 $m^2/g$ (and all values and ranges therebetween). The insoluble particles in the metal cast structure optionally are or include non-spherical particles. The insoluble particles in the metal cast structure optionally are or include nanotubes and/or nanowires. The non-spherical insoluble particles can optionally be used at the same volume and/or weight fraction to increase cathode particle surface area to control corrosion rates without changing composition. The insoluble particles in the metal cast structure optionally are or include spherical particles. The spherical particles (when used) can have the same or varying diameters. Such particles are optionally used at the same volume and/or weight fraction to increase cathode particle surface area to control corrosion rates without changing composition. Particle reinforcement in the metal cast structure can optionally be used to improve the mechanical properties of the metal cast structure and/or to act as part of the galvanic couple. The insoluble particles in the composite metal can optionally be used as a grain refiner, as a stiffening phase to the base metal or base metal alloy, and/or to increase the strength of the metal cast structure. The insoluble particles in the composite metal can optionally be less than about 1 μm in size (e.g., 0.001-0.999 μm and all values and ranges therebetween), typically less than about 0.5 μm, more typically less than about 0.1 μm, and more typically less than about 0.05 μm. The insoluble particles can optionally be dispersed throughout the composite metal using ultrasonic means, by electrowetting of the insoluble particles, and/or by mechanical agitation. The metal cast structure can optionally be used to form all or part of a device for use in hydraulic fracturing systems and zones for oil and gas drilling, wherein the device has a designed dissolving rate. The metal cast structure can optionally be used to form all or part of a device for structural support or component isolation in oil and gas drilling and completion systems, wherein the device has a designed dissolving rate.

In still yet another and/or alternative non-limiting aspect of the invention, there is provided a metal cast structure that includes a base metal or base metal alloy and a plurality of insoluble particles disbursed in said metal cast structure, wherein the insoluble particles have a melting point that is greater than a melting point of the base metal or base metal alloy, and at least 50% of the insoluble particles are located in grain boundary layers of the metal cast structure. The insoluble particles can optionally have a selected size and shape to control a dissolution rate of the metal cast structure. The insoluble particles can optionally have a different galvanic potential than a galvanic potential of the base metal or base metal alloy. The insoluble particles optionally have a galvanic potential that is more anodic than a galvanic potential of the base metal or base metal alloy. The insoluble particles optionally have a galvanic potential that is more cathodic than the galvanic potential of the base metal or base metal alloy. The base metal or base metal alloy optionally includes one or more metals selected from the group consisting of magnesium, zinc, titanium, aluminum, and iron. A plurality of the insoluble particles in the grain boundary layers optionally have a greater anodic potential than the base metal or base metal alloy, and wherein the insoluble particles include one or more materials selected form the group consisting of beryllium, magnesium, aluminum, zinc, cadmium, iron, tin and copper. A plurality of the insoluble particles in the grain boundary layers optionally have a greater cathodic potential than the base metal or base metal alloy, and wherein the insoluble particles include one or more materials selected from the group consisting of iron, copper, titanium, zinc, tin, cadmium lead, nickel, carbon and boron carbide. A plurality of the insoluble particles in the grain boundary layers optionally has a greater cathodic potential than a major component of the grain boundary layer. The major component of the grain boundary layer optionally includes one or more metals selected from the group consisting of magnesium, zinc, titanium, aluminum and iron. The major component of the grain boundary layer optionally has a different composition than the base metal or base metal alloy. A plurality of the insoluble particles in the grain boundary layers optionally has a greater anodic potential than a major component of the grain boundary layer. The major component of the grain boundary layer optionally includes one or more metals selected from the group consisting of magnesium, zinc, titanium, aluminum and iron. The major component of the grain boundary layer optionally has a different composition than the base metal or base metal alloy. The grain boundary layers optionally include a plurality of insoluble particles, and wherein the insoluble particles have a cathodic potential that is greater than a major component of the grain boundary layers, and wherein the major component of the grain boundary layer has a greater anodic potential than the composition of the grain boundary layers. The grain boundary layers optionally include one or more metals selected from the group consisting of magnesium, zinc, titanium, aluminum and iron. The insoluble particles resist forming compounds with the base metal or base metal alloy due to a solubility of the insoluble particles in the base metal or base metal alloy. The insoluble particles have a solubility in the base metal or base metal alloy of less than 5%, typically less than 1%, and more typically less than 0.5%. The metal cast structure can be increased in strength using deformation processing and which deformation processing changes a dissolution rate of the metal cast structure by less than 20%, typically less than 10%, more typically less than 5%, still more typically less than 1%, yet still more typically less than 0.5%. The insoluble particles optionally have a particle size of less than 1 μm. The insoluble particles are optionally nanoparticles. The insoluble particles optionally a) increase ductility of said metal cast structure, b) improve toughness of said metal cast structure, c) improve elongation of said metal cast structure, d) function as a grain refiner in said metal cast structure, e) function as a stiffening phase to said base metal or base metal alloy, f) increase strength of said metal cast structure, or combinations thereof. The insoluble particles optionally have a surface area of about 0.001 $m^2$/g-200 $m^2$/g. The insoluble particles optionally include nanotubes. The insoluble particles optionally include nanowires. The insoluble particles optionally include chopped fibers. The insoluble particles optionally include non-spherical particles. The insoluble particles optionally include spherical particles of varying diameters. The insoluble particles optionally include first and second particles, and wherein the first particles having a different composition than the second particles. The base metal or base metal alloy optionally includes magnesium or a magnesium alloy, and wherein the insoluble particles have a greater cathodic potential than the base metal or base metal alloy, and wherein the insoluble particles include one or more materials selected from the group consisting of carbon and iron. The base metal or base metal alloy optionally includes aluminum or an aluminum alloy, and wherein the insoluble particles optionally include first and second particles, and wherein the first particles optionally have a greater anodic potential than the base metal or base metal alloy, and wherein the first particles optionally include one or more materials selected from the group consisting of magnesium and magnesium alloy, and wherein the second particles optionally have a greater cathodic potential than the base metal or base metal alloy, and wherein the second particles optionally include one or more materials selected from the group consisting of carbon, iron and iron alloy. The base metal or base metal alloy optionally includes aluminum or an aluminum alloy, magnesium or magnesium alloy, and wherein insoluble particles optionally include first and second particles, and wherein the first particles optionally have a greater anodic potential than the base metal or base metal alloy, and wherein the first particles optionally include one or more materials selected from the group consisting of magnesium and magnesium alloy, and wherein the second particles optionally have a greater cathodic potential than said base metal or base metal alloy, and wherein the second particles optionally include titanium. The base metal or base metal alloy optionally includes aluminum or an aluminum alloy, the insoluble particles optionally include first and second particles, and wherein the first particles optionally have a greater anodic potential than the base metal or base metal alloy, and wherein the first particles optionally include one or more materials selected from the group consisting of magnesium and magnesium alloy, and wherein the second particles optionally have a greater cathodic potential than the base metal or base metal alloy, and wherein the second particles optionally include one or more materials selected from the group consisting of iron and iron alloy. The base metal or base metal alloy optionally includes aluminum or an aluminum alloy, and wherein the insoluble particles optionally include first and second particles, and wherein the first particles optionally have a greater anodic potential than the base metal or base metal alloy, and wherein the first particles optionally include magnesium, and wherein the second particles optionally have a greater cathodic potential than the base metal or base metal alloy, and wherein the second particles optionally include titanium. The base metal or base metal alloy optionally includes magnesium, aluminum, magnesium alloys or an aluminum alloy, and wherein the insoluble particles optionally have a greater cathodic potential than the base metal or base metal alloy, and wherein the insoluble particles optionally include titanium.

There is provided a method for forming a metal cast structure that includes a) providing one or more metals used to form a base metal or base metal alloy, b) providing a plurality of particles that have a low solubility when added to said one or more metals in a molten form, the plurality of particles having a melting point that is greater than a melting point of the base metal or base metal alloy; c) heating the one or more metals until molten; d) mixing the one or more molten metals and the plurality of particles to form a mixture and to cause the plurality of particles to disperse in the mixture; e) cooling the mixture to form the metal cast structure; and, wherein the plurality of particles are disbursed in the metal cast structure, and at least 50% of the plurality of particles are located in the grain boundary layers of the metal cast structure. The step of mixing optionally includes mixing using one or more processes selected from the group consisting of thixomolding, stir casting, mechanical agitation, electrowetting and ultrasonic dispersion. The method optionally includes the step of heat treating the metal cast structure to improve the tensile strength, elongation, or combinations thereof the metal cast structure without significantly affecting a dissolution rate of the metal cast structure. The method optionally includes the step of extruding or deforming the metal cast structure to improve the tensile strength, elongation, or combinations thereof of said metal cast structure without significantly affecting a dissolution rate of the metal cast structure. The method optionally includes the step of forming the metal cast structure into a device for a) separating hydraulic fracturing systems and zones for oil and gas drilling, b) structural support or component isolation in oil and gas drilling and completion systems, or combinations thereof. There is provided a method for forming a metal cast structure that includes mixing a base metal or a base metal alloy in molten form with insoluble particles to form a mixture; and cooling the mixture to form a metal cast structure.

One non-limiting objective of the present invention is the provision of a castable, moldable, or extrudable metal cast structure using a metal or metallic primary alloy that includes insoluble particles dispersed in the metal or metallic primary alloy.

Another and/or alternative non-limiting objective of the present invention is the provision of selecting the type and quantity of insoluble particles so that the grain boundaries of the metal cast structure has a desired composition and/or morphology to achieve a specific galvanic corrosion rate in the entire composite and/or along the grain boundaries of the metal cast structure.

Still another and/or alternative non-limiting objective of the present invention is the provision of forming a metal cast structure that the metal cast structure has insoluble particles located at the grain boundary during the solidification of the melt.

Yet another and/or alternative non-limiting objective of the present invention is the provision of forming a metal cast structure wherein the insoluble particles can be controllably located in the metal cast structure in the final casting, as well as the surface area ratio, which enables the use of lower cathode particle loadings compared to a powder metallurgical or alloyed composite to achieve the same dissolution rates.

Still yet another and/or alternative non-limiting objective of the present invention is the provision of forming a metal cast structure wherein the insoluble particles can be used to enhance mechanical properties of the composite, such as ductility and/or tensile strength.

Another and/or alternative non-limiting objective of the present invention is the provision of forming a metal cast structure that can be enhanced by heat treatment as well as deformation processing, such as extrusion, forging, or rolling, to further improve the strength of the final composite.

Still another and/or alternative non-limiting objective of the present invention is the provision of forming a metal cast structure that can be designed such that the rate of corrosion can be controlled through adjustment of cathode insoluble particle size (while not increasing or decreasing the volume or weight fraction of the insoluble particles) and/or by changing the volume/weight fraction (without changing the insoluble particle size).

Yet another and/or alternative non-limiting objective of the present invention is the provision of forming a metal cast structure that can be can be made into almost any shape.

Still yet another and/or alternative non-limiting objective of the present invention is the provision of forming a metal cast structure that, during solidification, the active reinforcement phases are pushed to the grain boundaries and the grain boundary composition is modified to achieve the desired dissolution rate.

Still yet another and/or alternative non-limiting objective of the present invention is the provision of forming a metal cast structure that can be designed such that galvanic corrosion only affects the grain boundaries and/or affects the grains based on composition.

Another and/or alternative non-limiting objective of the present invention is the provision of dispersing the insoluble particles in the metal cast structure by thixomolding, stir casting, mechanical agitation, electrowetting, ultrasonic dispersion and/or combinations of these processes.

Another and/or alternative non-limiting objective of the present invention is the provision of producing a metal cast structure with at least one insoluble phase in discrete particle form in the metal or metal alloy, and wherein the discrete insoluble particles have a different galvanic potential from the base metal or metal alloy.

Still another and/or alternative non-limiting objective of the present invention is the provision of producing a metal cast structure wherein the ratio of insoluble particles in the grain boundary is generally constant and the grain boundary to grain surface area is typically consistent even after deformation processing and/or heat treatment of the composite.

Yet another and/or alternative non-limiting objective of the present invention is the provision of producing a metal cast structure designed to corrode at the grains, the grain boundaries, and/or the insoluble particle additions depending on selecting where the particle additions fall on the galvanic chart.

Another and/or alternative non-limiting objective of the present invention is the provision of producing a metal cast structure wherein galvanic corrosion in the grains can be promoted by selecting a base metal or base metal alloy that sits at one galvanic potential in the operating solution of choice where its major grain boundary alloy composition will be more cathodic as compared to the matrix grains (i.e., grains that form in the casted base metal or base metal alloy), and an insoluble particle addition can be selected that is more cathodic component.

Still another and/or alternative non-limiting objective of the present invention is the provision of producing a metal cast structure having a slower corrosion rate by adding two or more different insoluble components to the base metal or base metal alloy to be deposited at the grain boundary, wherein the second insoluble component is the most anodic in the entire system.

Still yet another and/or alternative non-limiting objective of the present invention is the provision of producing a metal cast structure wherein the rate of corrosion in the entire casting system can be controlled by the surface area and, thus, the insoluble particle size and morphology of the insoluble particle additions.

Another and/or alternative non-limiting objective of the present invention is the provision of producing a metal cast structure wherein the grain boundary composition, and the size and/or shape of the insoluble particles can be used to control the dissolution rate of such metal cast structure.

Still another and/or alternative non-limiting objective of the present invention is the provision of producing a metal cast structure that includes two added insoluble components with different galvanic potentials, which insoluble components either are more anodic or more cathodic as compared to the base metal or base metal alloy.

Yet another and/or alternative non-limiting objective of the present invention is the provision of producing a metal cast structure that includes insoluble particles that have a solubility in the base metal or base metal alloy of less than about 5%.

Still yet another and/or alternative non-limiting objective of the present invention, there is provided a metal cast structure that can be used as a dissolvable, degradable and/or reactive structure in oil drilling. For example, the metal cast structure of the present invention can be used to form a frack ball or other structure in a well drilling or completion operation, such as a structure that is seated in a hydraulic operation, that can be dissolved away after use so that that no drilling or removal of the structure is necessary. Other types of structures can include, but are not limited to, sleeves, valves, hydraulic actuating tooling and the like. Such non-limiting structures or additional non-limiting structure are illustrated in U.S. Pat. Nos. 8,905,147; 8,717,268; 8,663,401; 8,631,876; 8,573,295; 8,528,633; 8,485,265; 8,403,037; 8,413,727; 8,211,331; 7,647,964; US Publication Nos. 2013/0199800; 2013/0032357; 2013/0029886; 2007/0181224; and WO 2013/122712, all of which are incorporated herein by reference.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
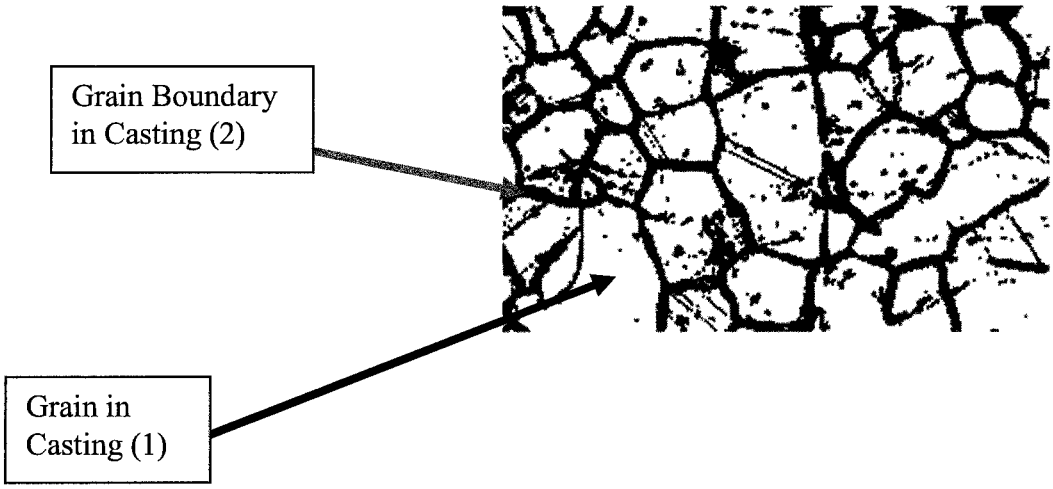
FIG. 1 illustrates a typical cast microstructure with grain boundaries (2) separating grains (1)

Referring now to the figures wherein the showings illustrate non-limiting embodiments of the present invention, the present invention is directed to a metal cast structure that includes insoluble particles dispersed in the cast metal material. The metal cast structure of the present invention can be used as a dissolvable, degradable and/or reactive structure in oil drilling. For example, the metal cast structure can be used to form a frack ball or other structure (e.g., sleeves, valves, hydraulic actuating tooling and the like, etc.) in a well drilling or completion operation. Although the metal cast structure has advantageous applications in the drilling or completion operation field of use, it will be appreciated that the metal cast structure can be used in any other field of use wherein it is desirable to form a structure that is controllably dissolvable, degradable and/or reactive.

The metal cast structure includes a base metal or base metal alloy having at least one insoluble phase in discrete particle form that is disbursed in the base metal or base metal alloy. The metal cast structure is generally produced by casting. The discrete insoluble particles have a different galvanic potential from the base metal or base metal alloy. The discrete insoluble particles are generally uniformly dispersed through the base metal or base metal alloy using techniques such as, but not limited to, thixomolding, stir casting, mechanical agitation, electrowetting, ultrasonic dispersion and/or combinations of these methods; however, this is not required. In one non-limiting process, the insoluble particles are uniformly dispersed through the base metal or base metal alloy using ultrasonic dispersion. Due to the insolubility and difference in atomic structure in the melted base metal or base metal alloy and the insoluble particles, the insoluble particles will be pushed to the grain boundary of the mixture of insoluble particles and the melted base metal or base metal alloy as the mixture cools and hardens during casting solidification. Because the insoluble particles will generally be pushed to the grain boundary, such feature makes it possible to engineer/customize grain boundaries in the metal cast structure to control the dissolution rate of the metal cast structure. This feature can be also used to engineer/customize grain boundaries in the metal cast structure through traditional deformation processing (e.g., extrusion, tempering, heat treatment, etc.) to increase tensile strength, elongation to failure, and other properties in the metal cast structure that were not achievable in cast metal structures that were absent insoluble particle additions. Because the amount or content of insoluble particles in the grain boundary is generally constant in the metal cast structure, and the grain boundary to grain surface area is also generally constant in the metal cast structure even after and optional deformation processing and/or heat treatment of the metal cast structure, the corrosion rate of the metal cast structure remains very similar or constant throughout the corrosion of the complete metal cast structure.

Figure 2:
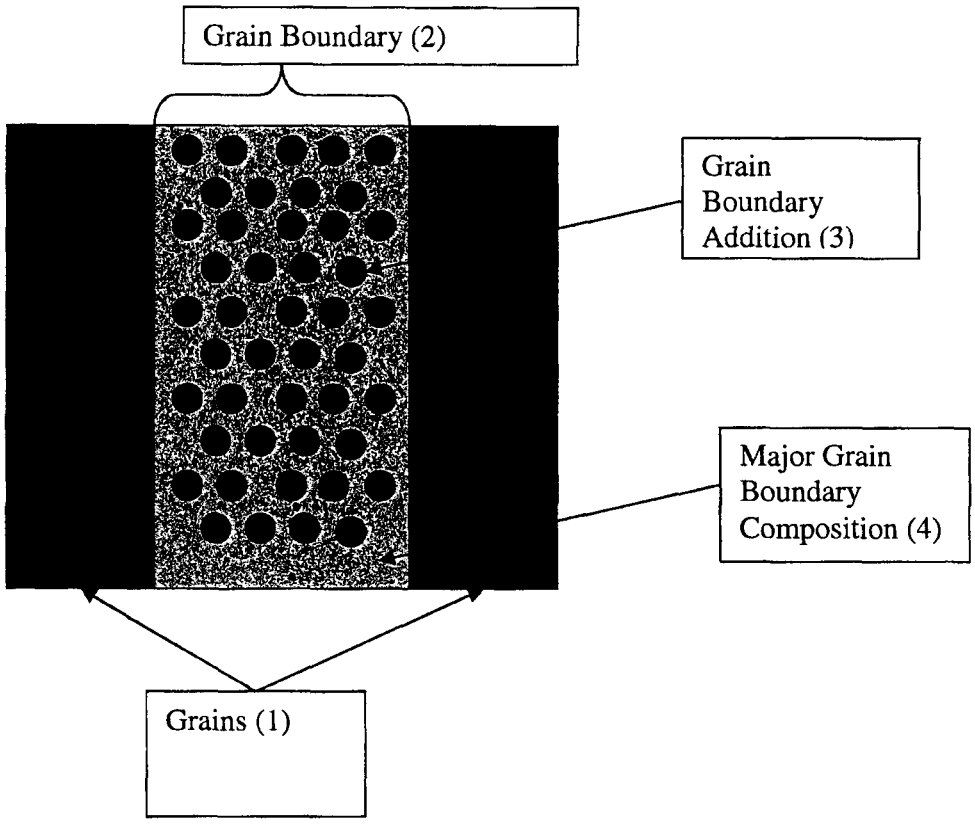
FIG. 2 illustrates a detailed grain boundary (2) between two grains (1) wherein there is one non-soluble grain boundary addition (3) in a majority of grain boundary composition (4) wherein the grain boundary addition, the grain boundary composition, and the grain all have different galvanic potentials and different exposed surface areas; and, FIG. 3 illustrates a detailed grain boundary (2) between two grains (1) wherein there are two non-soluble grain boundary additions (3 and 5) in a majority of grain boundary composition (4) wherein the grain boundary additions, the grain boundary composition, and the grain all have different galvanic potentials and different exposed surface areas.
Figure 3:
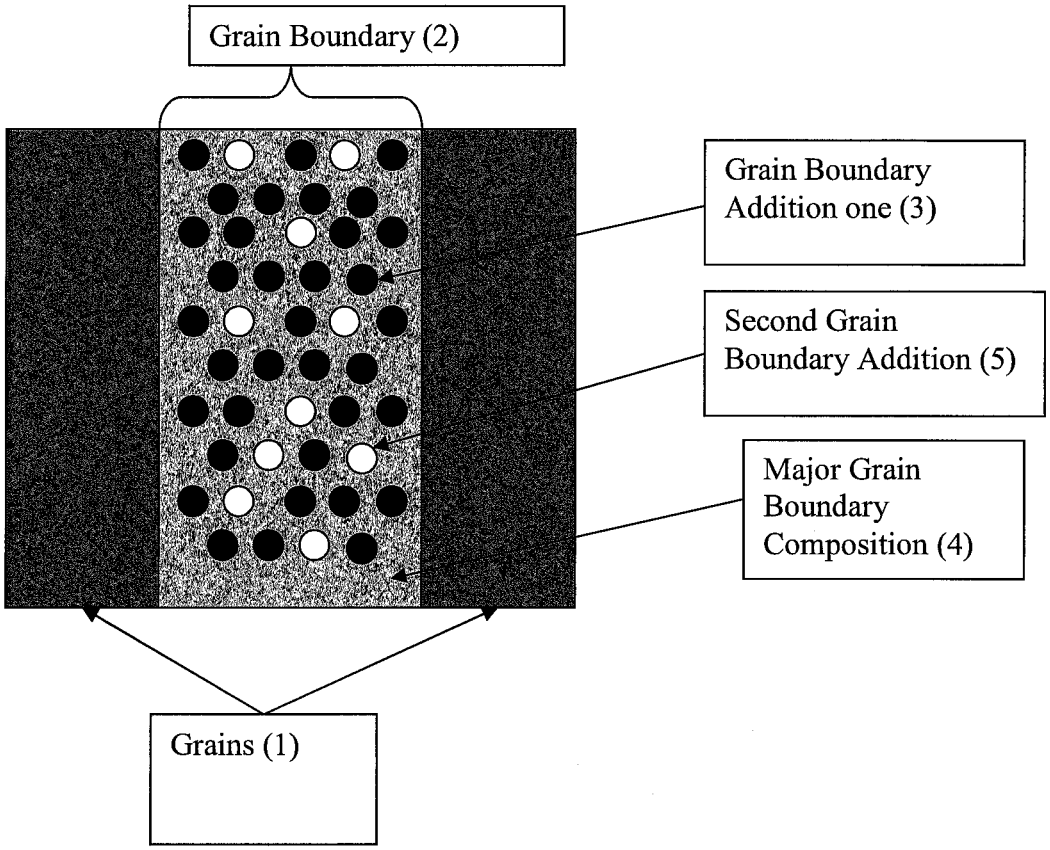

The metal cast structure can be designed to corrode at the grains in the metal cast structure, at the grain boundaries of the metal cast structure, and/or the location of the insoluble particle additions in the metal cast structure depending on selecting where the insoluble particle additions fall on the galvanic chart. For example, if it is desired to promote galvanic corrosion only along the grain boundaries (1) as illustrated in FIGS. 1-3, a metal cast structure can be selected such that one galvanic potential exists in the base metal or base metal alloy where its major grain boundary alloy composition (4) will be more anodic as compared to the matrix grains (i.e., grains that form in the casted base metal or base metal alloy) located in the major grain boundary, and then an insoluble particle addition (3) will be selected which is more cathodic as compared to the major grain boundary alloy composition. This combination will cause corrosion of the material along the grain boundaries, thereby removing the more anodic major grain boundary alloy (4) at a rate proportional to the exposed surface area of the cathodic particle additions (3) to the anodic major grain boundary alloy (4). The current flowing in the grain boundary can be calculated by testing zero resistance current of the cathode to the anode in a solution at a desired solution temperature and pressure that includes the metal cast structure. Corrosion of the metal cast structure will be generally proportional to current density/unit area of the most anodic component in the grain boundary and/or grains until that component is removed. If electrical conductivity remains between the remaining components in the grain boundary, the next most anodic component in the grain boundary and/or grains will next be removed at a desired temperature and pressure.

Galvanic corrosion in the grains (2) can be promoted in the metal cast structure by selecting a base metal or base metal alloy that has at one galvanic potential in the operating solution of choice (e.g., fracking solution, brine solution, etc.) where its major grain boundary alloy composition (4) is more cathodic as compared to the matrix grains (i.e., grains that form in the casted base metal or base metal alloy), and an insoluble particle addition (3) is selected that is more cathodic as compared to the major grain boundary alloy composition and the base metal or base metal alloy. This combination will result in the corrosion of the metal cast structure through the grains by removing the more anodic grain (2) composition at a rate proportional to the exposed surface area of the cathodic non-soluble particle additions (3) to the anodic major grain boundary alloy (4). The current flowing in the metal cast structure can be calculated by testing zero resistance current of the cathode to the anode in a solution at a desired solution temperature and pressure that includes the metal cast structure. Corrosion of the metal cast structure will be generally proportional to current density/unit area of the most anodic component in the grain boundary and/or grains until that component is removed. If electrical conductivity remains between the remaining components in the grain boundary, the next most anodic component in the grain boundary and/or grains will next be removed at a desired temperature and pressure.

If a slower corrosion rate of the metal cast structure is desired, two or more insoluble particle additions can be added to the metal cast structure to be deposited at the grain boundary as illustrated in FIG. 3. If the second insoluble particle (5) is selected to be the most anodic in the metal cast structure, the second insoluble particle will first be corroded, thereby generally protecting the remaining components of the metal cast structure based on the exposed surface area and galvanic potential difference between second insoluble particle and the surface area and galvanic potential of the most cathodic system component. When the exposed surface area of the second insoluble particle (5) is removed from the system, the system reverts to the two previous embodiments described above until more particles of second insoluble particle (5) are exposed. This arrangement creates a mechanism to retard corrosion rate with minor additions of the second insoluble particle component.

The rate of corrosion in the metal cast structure can also be controlled by the surface area of the insoluble particle. As such the particle size, particle morphology and particle porosity of the insoluble particles can be used to affect the rate of corrosion of the metal cast structure. The insoluble particles in the metal cast structure can optionally have a surface area of 0.001 $m^2/g$-200 $m^2/g$ (and all values and ranges therebetween). The insoluble particles in the metal cast structure optionally are or include non-spherical particles. The insoluble particles in the metal cast structure optionally are or include nanotubes and/or nanowires. The non-spherical insoluble particles can optionally be used at the same volume and/or weight fraction to increase cathode particle surface area to control corrosion rates without changing composition. The insoluble particles in the metal cast structure optionally are or include spherical particles. The spherical particles (when used) can have the same or varying diameters. Such particles are optionally used at the same volume and/or weight fraction to increase cathode particle surface area to control corrosion rates without changing composition.

The major grain boundary composition of the metal cast structure metal cast structure can include magnesium, zinc, titanium, aluminum, iron, or any combination or alloys thereof. The added insoluble particle component that has a more anodic potential than the major grain boundary composition can include, but is not limited to, beryllium, magnesium, aluminum, zinc, cadmium, iron, tin, copper, and any combinations and/or alloys thereof. The added insoluble particle component that has a more cathodic potential than the major grain boundary composition can include, but is not limited to, iron, copper, titanium, zinc, tin, cadmium lead, nickel, carbon, boron carbide, and any combinations and/or alloys thereof. The grain boundary layer can include an added insoluble particle component that is more cathodic as compared to the major grain boundary composition. The composition of the grain boundary layer can optionally include an added component that is more anodic as compared to the major component of the grain boundary composition. The composition of the grain boundary layer can optionally include an added insoluble particle component that is more cathodic as compared to the major component of the grain boundary composition and the major component of the grain boundary composition can be more anodic than the grain composition. The cathodic components or anodic components can be compatible with the base metal or metal alloy (e.g., matrix material) in that the cathodic components or anodic components can have solubility limits and/or do not form compounds.

The insoluble particle component (anodic component or cathodic component) that is added to the metal cast structure generally has a solubility in the grain boundary composition of less than about 5% (e.g., 0.01-4.99% and all values and ranges therebetween), typically less than about 1%, and more typically less than about 0.5%. The composition of the cathodic or anodic insoluble particle components in the grain boundary can be compatible with the major grain boundary material in that the cathodic components or anodic components can have solubility limits and/or do not form compounds.

The strength of the metal cast structure can optionally be increased using deformation processing and a change dissolution rate of the metal cast structure of less than about 20% (e.g., 0.01-19.99% and all values and ranges therebetween), typically less than about 10%, and more typically less than about 5%.

The ductility of the metal cast structure can optionally be increased using insoluble nanoparticle cathodic additions. In one non-limiting specific embodiment, the metal cast structure includes a magnesium and/or magnesium alloy as the base metal or base metal alloy, and more insoluble nanoparticle cathodic additions include carbon and/or iron. In another non-limiting specific embodiment, the metal cast structure includes aluminum and/or aluminum alloy as the base metal or base metal alloy, and more anodic galvanic potential insoluble nanoparticles include magnesium or magnesium alloy, and high galvanic potential insoluble nanoparticle cathodic additions include carbon, iron and/or iron alloy. In still another non-limiting specific embodiment, the metal cast structure includes aluminum, aluminum alloy, magnesium and/or magnesium alloy as the base metal or base metal alloy, and the more anodic galvanic potential insoluble nanoparticles include magnesium and/or magnesium alloy, and the more insoluble nanoparticle cathodic additions include titanium. In yet another non-limiting specific embodiment, the metal cast structure includes aluminum and/or aluminum alloy as the base metal or base metal alloy, and the more anodic galvanic potential insoluble nanoparticles include magnesium and/or magnesium alloy, and the high galvanic potential insoluble nanoparticle cathodic additions include iron and/or iron alloy. In still yet another non-limiting specific embodiment, the metal cast structure includes aluminum and/or aluminum alloy as the base metal or base metal alloy, and the more anodic galvanic potential insoluble nanoparticles include magnesium and/or magnesium alloy, and the high galvanic potential insoluble nanoparticle cathodic additions include titanium. In another non-limiting specific embodiment, the metal cast structure includes magnesium, aluminum, magnesium alloys and/or aluminum alloy as the base metal or base metal alloy, and the high galvanic potential insoluble nanoparticle cathodic additions include titanium.

The metal cast structure can optionally include chopped fibers. These additions to the metal cast structure can be used to improve toughness of the metal cast structure.

The metal cast structure can have improved tensile strength and/or elongation due to heat treatment without significantly affecting the dissolution rate of the metal cast structure.

The metal cast structure can have improved tensile strength and/or elongation by extrusion and/or another deformation process for grain refinement without significantly affecting the dissolution rate of the metal cast structure. In such a process, the dissolution rate change can be less than about 10% (e.g., 0-10% and all values and ranges therebetween), typically less than about 5%, and more typically less than about 1%.

Particle reinforcement in the metal cast structure can optionally be used to improve the mechanical properties of the metal cast structure and/or to act as part of the galvanic couple.

The insoluble particles in the metal cast structure can optionally be used as a grain refiner, as a stiffening phase to the base metal or metal alloy (e.g., matrix material), and/or to increase the strength of the metal cast structure.

The insoluble particles in the metal cast structure are generally less than about 1 μm in size (e.g., 0.00001-0.999 μm and all values and ranges therebetween), typically less than about 0.5 μm, more typically less than about 0.1 μm, and typically less than about 0.05 μm, still more typically less than 0.005 μm, and yet still more typically no greater than 0.001 μm (nanoparticle size).

The total content of the insoluble particles in the metal cast structure is generally about 0.01-70 wt. % (and all values and ranges therebetween), typically about 0.05-49.99 wt. %, more typically about 0.1-40 wt %, still more typically about 0.1-30 wt. %, and even more typically about 0.5-20 wt. %. When more than one type of insoluble particle is added in the metal cast structure, the content of the different types of insoluble particles can be the same or different. When more than one type of insoluble particle is added in the metal cast structure, the shape of the different types of insoluble particles can be the same or different. When more than one type of insoluble particle is added in the metal cast structure, the size of the different types of insoluble particles can be the same or different.

The insoluble particles can optionally be dispersed throughout the metal cast structure using ultrasonic means, by electrowetting of the insoluble particles, and/or by mechanical agitation.

The metal cast structure can optionally be used to form all or part of a device for use in hydraulic fracturing systems and zones for oil and gas drilling, wherein the device has a designed dissolving rate. The metal cast structure can optionally be used to form all or part of a device for structural support or component isolation in oil and gas drilling and completion systems, wherein the device has a designed dissolving rate.

Example 1

An AZ91D magnesium alloy having 9 wt. % aluminum, 1 wt. % zinc and 90 wt. % magnesium was melted to above 700° C. About 16 wt. % of 75 um iron particles were added to the melt and dispersed. The melt was cast into a steel mold. The iron particles did not fully melt during the mixing and casting processes. The cast material exhibited a tensile strength of about 26 ksi, and an elongation of about 3%. The cast material dissolved at a rate of about 2.5 mg/cm$^2$-min in a 3% KCl solution at 20° C. The material dissolved at a rate of 60 mg/cm$^2$-hr in a 3% KCl solution at 65° C. The material dissolved at a rate of 325 mg/cm$^2$-hr. in a 3% KCl solution at 90° C. The dissolving rate of metal cast structure for each these test was generally constant. The iron particles were less than 1 μm, but were not nanoparticles. However, the iron particles could be nanoparticles, and such addition would change the dissolving rate of metal cast structure.

Example 2

An AZ91D magnesium alloy having 9 wt. % aluminum, 1 wt. % zinc and 90 wt. % magnesium was melted to above 700° C. About 2 wt. % 75 um iron particles were added to the melt and dispersed. The melt was cast into steel molds. The iron particles did not fully melt during the mixing and casting processes. The material exhibited a tensile strength of 26 ksi, and an elongation of 4%. The material dissolved at a rate of 0.2 mg/cm$^2$-min in a 3% KCl solution at 20° C. The material dissolved at a rate of 1 mg/cm$^2$-hr in a 3% KCl solution at 65° C. The material dissolved at a rate of 10 mg/cm$^2$-hr in a 3% KCl solution at 90° C. The dissolving rate of metal cast structure for each these test was generally constant. The iron particles were less than 1 μm, but were not nanoparticles. However, the iron particles could be nanoparticles, and such addition would change the dissolving rate of metal cast structure.

Example 3

An AZ91D magnesium alloy having 9 wt. % aluminum, 1 wt. % zinc and 90 wt. % magnesium was melted to above 700° C. About 2 wt. % nano iron particles and about 2 wt. % nano graphite particles were added to the composite using ultrasonic mixing. The melt was cast into steel molds. The iron particles and graphite particles did not fully melt during the mixing and casting processes. The material dissolved at a rate of 2 mg/cm$^2$-min in a 3% KCl solution at 20° C. The material dissolved at a rate of 20 mg/cm$^2$-hr in a 3% KCl solution at 65° C. The material dissolved at a rate of 100 mg/cm$^2$-hr in a 3% KCl solution at 90° C. The dissolving rate of metal cast structure for each these test was generally constant.

Example 4

The composite in Example 1 was subjected to extrusion with an 11:1 reduction area. The extruded metal cast structure exhibited a tensile strength of 38 ksi, and an elongation to failure of 12%. The extruded metal cast structure dissolved at a rate of 2 mg/cm$^2$-min in a 3% KCl solution at 20° C. The extruded metal cast structure dissolved at a rate of 301 mg/cm$^2$-min in a 3% KCl solution at 20° C. The extruded metal cast structure exhibit an improvement of 58% tensile strength and an improvement of 166% elongation with less than 10% change in dissolution rate as compared to the non-extruded metal cast structure.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A metal cast structure that includes a base metal material and a plurality of insoluble particles disbursed in said metal cast structure to obtain a desired dissolution rate of said metal cast structure, said insoluble particles having a melting point that is greater than a melting point of said base metal material, said insoluble particles have a solubility of less than about 5% in said base metal material, said insoluble particles have a size that is less than about 1 μm, said insoluble particles constitute about 0.1-40 wt % of said metal cast structure, at least 50% of said insoluble particles located in grain boundary layers of said metal cast structure, said insoluble particles selected and used in a quantity to obtain a composition and morphology of said grain boundary layers to obtain a galvanic corrosion rate along said grain boundary layers, said insoluble particles have a different galvanic potential from said base metal material, said base metal material includes one or more metals selected from the group consisting of magnesium, zinc, titanium, aluminum, and iron, said insoluble particles including one or more materials selected from the group consisting of iron, copper, titanium, zinc, tin, cadmium, lead, nickel, carbon, iron alloy, copper alloy, titanium alloy, zinc alloy, tin alloy, cadmium alloy, lead alloy, and nickel alloy.

2. The metal cast structure as defined in claim 1, wherein said insoluble particles have a selected size and shape to control a dissolution rate of said metal cast structure.

3. The metal cast structure as defined in claim 1, wherein said base metal material includes a majority weight percent magnesium.

4. The metal cast structure as defined in claim 1, wherein a plurality of said insoluble particles in said grain boundary layers have a greater anodic potential than said base metal material, said insoluble particles include one or more materials selected from the group consisting of beryllium, magnesium, aluminum, zinc, cadmium, iron, tin and copper.

5. The metal cast structure as defined in claim 1, wherein a plurality of said insoluble particles in said grain boundary layers have a greater cathodic potential than said base metal material, said insoluble particles include one or more materials selected from the group consisting of iron, copper, titanium, zinc, tin, cadmium lead, nickel, carbon and boron carbide.

6. The metal cast structure as defined in claim 1, wherein a plurality of said insoluble particles in said grain boundary layers have a greater cathodic potential than a major component of said grain boundary layer.

7. The metal cast structure as defined in claim 6, wherein said major component of said grain boundary layer includes one or more metals selected from the group consisting of magnesium, zinc, titanium, aluminum and iron.

8. The metal cast structure as defined in claim 6, wherein said major component of said grain boundary layer has a different composition than said base metal material.

9. The metal cast structure as defined in claim 1, wherein a plurality of said insoluble particles in said grain boundary layers have a greater anodic potential than a major component of said grain boundary layer.

10. The metal cast structure as defined in claim 9, wherein said major component of said grain boundary layer includes one or more metals selected from the group consisting of magnesium, zinc, titanium, aluminum and iron.

11. The metal cast structure as defined in claim 9, wherein said major component of said grain boundary layer has a different composition than said base metal material.

12. The metal cast structure as defined in claim 1, wherein said grain boundary layers include a plurality of said insoluble particles, said insoluble particles having a cathodic potential that is greater than a major component of said grain boundary layers, said major component of said grain boundary layer having a greater anodic potential than said composition of said grain boundary layers.

13. The metal cast structure as defined in claim 12, wherein said grain boundary layers includes one or more metals selected from the group consisting of magnesium, zinc, titanium, aluminum and iron.

14. The metal cast structure as defined in claim 1, wherein said insoluble particles resist forming compounds with said base metal material due to a solubility of said insoluble particles in said base metal material, said insoluble particles having a solubility in said base metal material of less than 1%.

15. The metal cast structure as defined in claim 1, wherein said metal cast structure can be increased in strength using deformation processing and which deformation processing changes a dissolution rate of said metal cast structure by less than 20%.

16. The metal cast structure as defined in claim 1, wherein said insoluble particles have a particle size of less than 0.5 μm.

17. The metal cast structure as defined in claim 1, wherein said insoluble particles have a surface area of about 0.001 $m^2/g$-200 $m^2/g$.

18. The metal cast structure as defined in claim 1, wherein said insoluble particles include nanotubes, nanowires, chopped fibers or combinations thereof.

19. The metal cast structure as defined in claim 1, wherein said insoluble particles include non-spherical particles.

20. The metal cast structure as defined in claim 1, wherein said insoluble particles include spherical particles of varying diameters.

21. The metal cast structure as defined in claim 1, wherein said insoluble particles include first and second particles, said first particles having a different composition than said second particles.

22. A metal cast structure that includes a base metal material and a plurality of insoluble particles disbursed in said metal cast structure to obtain a desired dissolution rate of said metal cast structure, said insoluble particles having a melting point that is greater than a melting point of said base metal material, said insoluble particles constitute about 0.1-40 wt % of said metal cast structure, said insoluble particles having a melting point of greater than 700° C., said base metal material including a majority weight percent magnesium, at least 50% of said insoluble particles located in grain boundary layers of said metal cast structure, said insoluble particles are selected and used in a quantity to obtain a composition and morphology of said grain boundary layers to obtain a galvanic corrosion rate along said grain boundary layers, said insoluble particles have a different galvanic potential from said base metal material, said insoluble particles having a melting point of greater than 700° C.

23. The metal cast structure as defined in claim 22, wherein said insoluble particles include one or more materials selected from the group consisting of iron, graphite, beryllium, copper, titanium, nickel, and carbon.

24. The metal cast structure as defined in claim 23, wherein said insoluble particles constitute 0.05-49.99 wt % of said metal cast structure.

25. The metal cast structure as defined in claim 24, wherein said base metal material includes aluminum and zinc.

26. The metal cast structure as defined in claim 25, wherein an average particle size of said insoluble particles is less than 1 μm.

27. The metal cast structure as defined in claim 26, wherein said insoluble particles includes a first and second particle type, said first and second particle type having a different composition.

28. The metal cast structure as defined in claim 27, wherein said first and second particle types of said insoluble particles having a different galvanic potential.

29. The metal cast structure as defined in claim 28, wherein at least one of said first and second particle types of said insoluble particles have a greater cathodic potential than a major component of said grain boundary layer.

30. The metal cast structure as defined in claim 26, wherein a plurality of said insoluble particles have a greater cathodic potential than a major component of said grain boundary layer.

31. The metal cast structure as defined in claim 22, wherein said insoluble particles constitute 0.05-49.99 wt % of said metal cast structure.

32. The metal cast structure as defined in claim 22, wherein said base metal material includes aluminum and zinc.

33. The metal cast structure as defined in claim 22, wherein an average particle size of said insoluble particles is less than 1 μm.

34. The metal cast structure as defined in claim 22, wherein said insoluble particles includes a first and second particle type, said first and second particle type having a different composition.

35. The metal cast structure as defined in claim 34, wherein said first and second particle types of said insoluble particles having a different galvanic potential.

36. The metal cast structure as defined in claim 35, wherein at least one of said first and second particle types of said insoluble particles have a greater cathodic potential than a major component of said grain boundary layer.

37. The metal cast structure as defined in claim 22, wherein a plurality of said insoluble particles have a greater cathodic potential than a major component of said grain boundary layer.

38. The metal case structure as defined in claim 22, wherein said base metal material is an alloy of magnesium, aluminum and zinc, an aluminum content in said base metal material is greater than a zinc content, said insoluble particles include one or more materials selected from the group consisting of iron particles and graphite particles, said insoluble particles having a particle size of less than 1 μm.

39. The metal case structure as defined in claim 38, wherein said base metal material includes at least 90 wt % magnesium.

40. The metal case structure as defined in claim 39, wherein insoluble particles constitute 0.5-20 wt % of said metal case structure.

41. The metal case structure as defined in claim 40, wherein said insoluble particles include both iron particles and graphite particles.

* * * * *